United States Patent [19]

Klaus

[11] Patent Number: 4,729,073

[45] Date of Patent: Mar. 1, 1988

[54] LAMP MOUNTING

[75] Inventor: Dale A. Klaus, St. Louis, Mo.

[73] Assignee: Dal Partnership, St. Louis, Mo.

[21] Appl. No.: 30,342

[22] Filed: Mar. 26, 1987

[51] Int. Cl.[4] ..... F21S 1/02

[52] U.S. Cl. ..... 362/147; 362/368; 362/432

[58] Field of Search ..... 362/432, 145, 147, 368, 362/370, 152

[56] References Cited

U.S. PATENT DOCUMENTS

| | | | |
|---|---|---|---|
| 1,697,170 | 1/1929 | Ermold | 362/432 |
| 3,678,265 | 7/1972 | Porter et al. | 362/368 |
| 4,245,284 | 1/1981 | Moore et al. | 362/432 |
| 4,605,995 | 8/1986 | Pike | 362/370 |
| 4,635,168 | 1/1987 | Crowley | 362/147 |

*Primary Examiner*—William A. Cuchlinski, Jr.
*Assistant Examiner*—D. M. Cox
*Attorney, Agent, or Firm*—Rey Eilers

[57] ABSTRACT

The present invention provides a plastic support, for an electric lamp and for the enclosure for that lamp, which is resistant to flame, heat, cold, water, ice, sunshine and other natural environmental conditions; and that support makes it possible to eliminate the traditional metal mounting pan, length of metal pipe, and securing fittings. As a result, the support of the present invention can directly engage a wall rather than engage a metal mounting pan which must engage that wall, and the flexible conductors from the socket can be given a random orientation from that socket to the power-supplying conductors in the wall instead of having to assume the fixed orientation imposed by the use of a length of metal pipe. This means that the conductors can be shorter than normal; because of the elimination of the depth of the metal mounting pan, and also because the wires assume orientations comparable to hypotenuses rather than orientations resembling the altitudes and bases of triangles.

3 Claims, 5 Drawing Figures

FIG. 1.
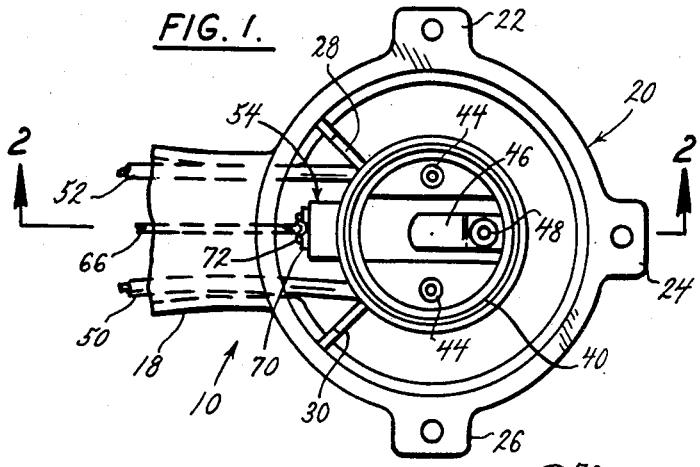
FIG. 2.
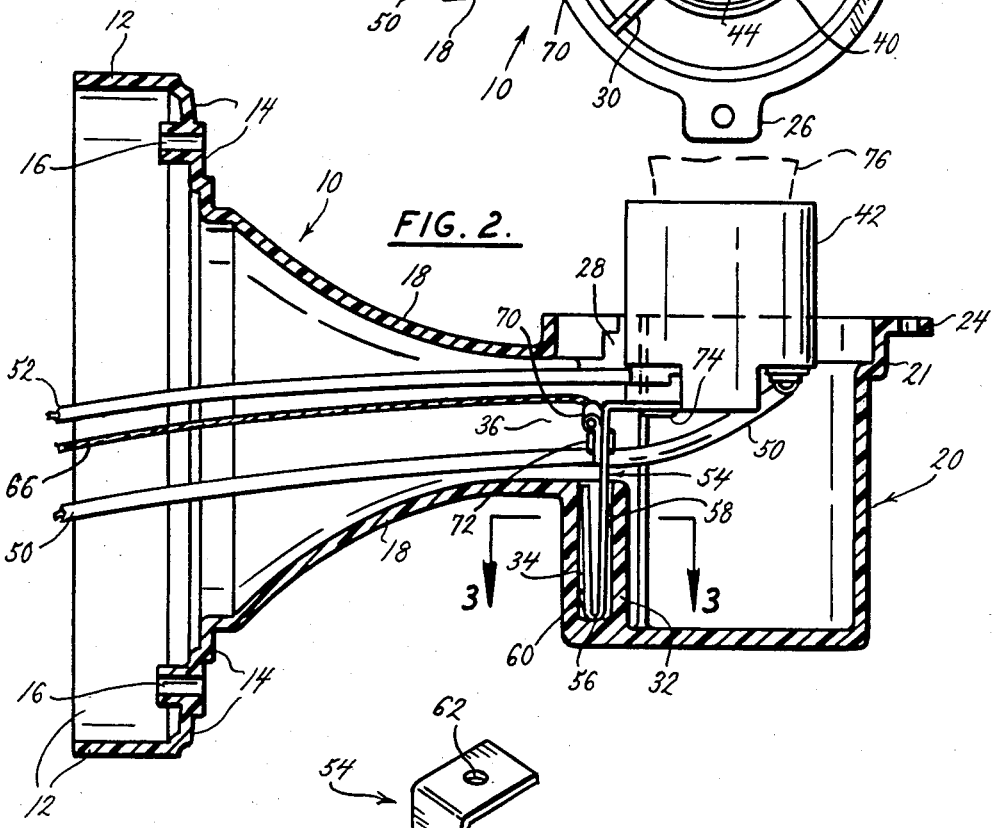
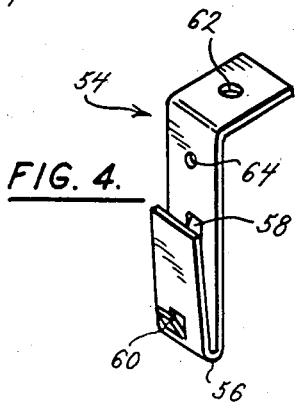
FIG. 4.
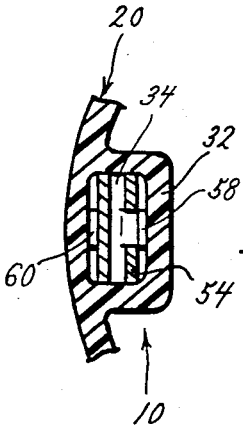
FIG. 3.
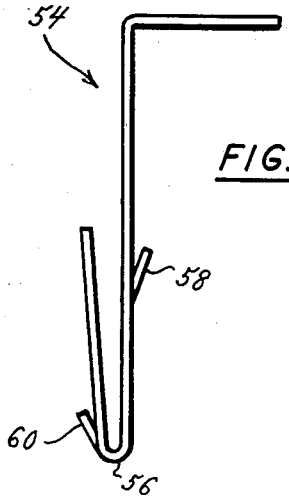
FIG. 5.

LAMP MOUNTING

BACKGROUND OF THE INVENTION

Supports for electric lamps and enclosures for those lamps traditionally include, or are secured to, metal mounting pans that engage a wall or ceiling. At least one insulated socket, which is equipped with a brass screwshell to receive the Edison-base of an electric lamp, is fixedly secured within that support. Where the support is made of plastic material and is intended to simulate an ornamental torch base, it is customary to fixedly secure a bracket to the socket, to fixedly secure one end of a length of metal pipe to that bracket, and then to fixedly secure the other end of that length of metal pipe to the metal mounting pan. The length of metal pipe has been required by the Underwriters Laboratories, Inc. as a protection against fire, in the event the plastic support were to melt or catch fire. However, the cost of the metal mounting pan, of the length of metal pipe, and of the fasteners which secure that length of metal pipe to that socket and also to that metal mounting pan coact with the cost of the labor involved in assembling that length of metal pipe with that socket, and in assembling that length of metal pipe with that metal mounting pan, to make the use of a metal mounting pan and of a length of metal pipe needlessly costly.

SUMMARY OF THE INVENTION

The present invention provides a plastic support, for an electric lamp and for the enclosure for that lamp, which is resistant to flame, heat, cold, water, ice, sunshine and other natural environmental conditions; and that support makes it possible to eliminate the traditional metal mounting pan, length of metal pipe, and securing fittings. As a result, the support of the present invention can directly engage a wall rather than engage a metal mounting pan which must engage that wall, and the flexible conductors from the socket can be given a random orientation from that socket to the power-supplying conductors in the wall instead of having to assume the fixed orientation imposed by the use of a length of metal pipe. This means that the conductors can be shorter than normal; because of the elimination of the depth of the metal mounting pan, and also because the wires assume orientations comparable to hypotenuses rather than orientations resembling the altitudes and bases of triangles. It is, therefore, an object of the present invention to provide a support for an electric lamp, and for the enclosure for that lamp, which is made from a plastic material that is resistant to flame, heat, cold, water, ice, sunshine and other natural environmental conditions so that support can directly engage a wall rather than engage a metal mounting pan which engages that wall.

The present invention secures a lamp socket to the support by a resilient bracket; and that bracket limits the magnitude of the forces which can be applied between that socket and abutments at the interior of that support. Those maximum forces are very substantially below the bending or crushing resistance of those abutments; and hence those abutments will always hold the lamp socket squarely in position within the support and will not be bent or crushed, and thereby permit the lamp socket to be disposed in an offset position. This is in contrast to prior supports, which permitted heavy-handed installers to tighten the metal mounting pans to the lengths of metal pipe to such an extent that the abutments of the supports could be bent or crushed. It is, therefore, an object of the present invention to provide a support which has socket-positioning abutments therein and to provide a resilient bracket which secures a socket to that support but which limits the maximum force that can be developed between that socket and those abutments.

Other and further objects and advantages of the present invention should become apparent from an examination of the drawing and accompanying description.

In the drawing and accompanying description, a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

In the drawing,

FIG. 1 is a plan view of a part of one preferred embodiment of support which is provided by the present invention;

FIG. 2 is a sectional view which is taken along a plane that is indicated by the line 2—2 in FIG. 1;

FIG. 3 is a sectional view which is taken along a plane that is indicated by the line 3—3 in FIG. 2;

FIG. 4 is a perspective view, on a larger scale, of the resilient bracket used to secure the lamp socket to the support of FIGS. 1 and 2; and FIG. 5 is a side view, on a still larger scale, of the resilient bracket of FIG. 4.

DETAILED DESCRIPTION OF PREFERRED EMBODIMENT

Referring to the drawing in detail, the numeral 10 generally denotes a torch-like support which is made from a polycarbonate. Because the support 10 is made from a polycarbonate, it is resistant to flame, heat, cold, water, ice, sunshine and all other potentially hurtful environmental conditions. That support has a wall-engaging collar 12 which is shown in FIG. 2 as being quite large, and which usually is circular in end view. A stepped flange 14 extends inwardly from the wall-engaging collar 12; and it has two fastener-receiving reinforced openings 16 through it. Those openings will receive screws or other fasteners, not shown, which will secure the support 10 to an electrical box or other mounting device within the wall. The numeral 18 denotes a bell-like throat or passage, for the support 10, which projects outwardly from the flange 14 and which extends to a cylindrical upper end of an ornamental portion of the support 10; and that cylindrical upper end is generally denoted by the numeral 20. An offset collar 21 is provided at the upper edge of the cylindrical upper end 20; and ears 22, 24 and 26 on that collar, which are each provided with an opening therein, are spaced apart approximately ninety degrees, as shown by FIG. 1. Those openings in those ears will receive fasteners that can releasably secure an enclosure to the upper surface of the cylindrical upper end 20. A plate-like abutment 28 is formed at the inner surface of the cylindrical upper end 20, and that abutment extends downwardly into the ornamental lower portion, not shown, of the torch-like support. A similar plate-like abutment is denoted by the numeral 30; and it is spaced approximately ninety degrees from the abutment 28. Each of those abutments is spaced about forty-five degrees from the axis of the throat 18, as shown particularly by FIG. 1.

The numeral 32 denotes a boss which is located within the support 10 below the level of an opening 36 between the throat 18 and the upper end 20 of that support. That boss extends inwardly from that portion of the wall of the upper end 20 in which the opening 36 is located. A recess 34 is formed in that boss, and that recess opens toward the upper part of the upper end 20.

The support 10 is formed as a homogenous molding which includes the collar 12, the flange 14, the openings 16, the throat 18, the upper end 20, the torch-like lower portion of that support, the offset collar 21, the ears 22, 24 and 26, the plate-like abutments 28 and 30, the boss 32, the recess 34, and the opening 36. In one embodiment of the present invention, that support has the dimensions and configurations of a prior torch-like support for an electric lamp and the enclosure therefor; but it is made from a polycarbonate rather than from a polypropylene plastic material. As a result, the support 10 makes it possible to eliminate the metal mounting pan, length of metal pipe, and attachments between that length of metal pipe and that metal mounting pan which had to be used with the polypropylene plastic support. Also, the support 10 makes it possible to use flexible conductors which are shorter than the traditional flexible conductors; because those conductors do not have to pass through a length of pipe which is normal to a wall and then bend abruptly to reach the power-supplying conductors in the wall.

The numeral 40 denotes a standard brass screwshell which is intended to receive the Edison-base of an electric lamp 76. That screwshell will be disposed within an insulated housing 42; and it will be held there by tubular rivets 44. A flexible contact 46 will be secured to the housing 42 by a tubular rivet 48; and a flexible insulated conductor 50 will be fixedly secured to the rivet 48, while a flexible insulated conductor 52 will be secured to one of the tubular rivets 44. The numeral 54 generally denotes an inverted L-shaped bracket with a re-entrant bend 56. A tang 58 is formed in the leg of the bracket 54, and a further tang 60 is provided in that bracket adjacent the re-entrant bend 56, as shown particularly by FIGS. 4 and 5. A hole 62 is provided in the foot of the bracket 54, and a smaller hole 64 is provided in the leg of that bracket. That bracket is made from a springy, resilient metal such as spring steel. The tangs 60 and 58 will be formed by punching operations, and hence will have burrs and ragged edges thereon which will enable them to bite into the walls of the recess 34 in the boss 32 of the support 10. Consequently, once the re-entrant bend 56 of the bracket 54 has been pressed into the recess 34, as shown by FIGS. 2 and 3, that bracket will not accidentally come loose from the support 10.

A rivet 74 will pass through the opening 62 in the foot of the bracket 54 and will be secured to the insulated mounting 42. Prior to the time the bracket 54 is secured to the insulated mounting 42, and considerably prior to the time that bracket has the re-entrant bend 56 thereof pressed into the recess 34 in the boss 32, a fitting 70 on the end of a bare grounding wire 66 will be secured to that bracket by a rivet 72, which will be seated within the opening 64 in the leg of that bracket.

Once the insulated housing 42 has had the bracket 54, the screwshell 40, the contact 46, and the conductors 50, 52 and 66 secured to it, those conductors will be passed through the opening 36 between the upper end 20 of the torch-like portion of the support and the throat 18. Thereafter, the re-entrant bend 56 of the bracket 54 will be pressed downwardly into the recess 34 of boss 32, as shown particularly by FIGS. 2 and 3. The upper portion of the leg and/or the adjacent portion of the foot of the bracket 54 will be bent slightly as the re-entrant bend 56 of that bracket is forced downwardly into the recess 34 of the boss 32; because the side of the insulated housing 42 will be forced slightly to the right of the unstressed position it would tend to assume as that re-entrant bend was pressed down into that recess. The restorative forces within the bracket 54 will urge the left-hand side of the exterior of the insulated housing 42 against the free edges of the plate-like abutments 28 and 30. Those restorative forces will cause that left-hand side of that exterior to be held in intimate engagement with those plate-like abutments, but those restorative forces will provide a force which is far too small to cause any bending or crushing of either of those abutments. Once the support and the insulated housing 42 have been assembled as a unit, that unit can be shipped through the usual channels of trade to the contractor or to the homeowner who will install it.

The contractor or the homeowner will suitably attach the free ends of the insulated flexible conductors 50 and 52 to the power-supplying conductors within a wall. One of those insulated flexible conductors will have the color which traditionally indicates that it is to be connected to the "hot" side of the power supply; and the other of those insulated flexible conductors will have the color which traditionally indicates that it is to be connected to the "grounded" side of that power supply. The bare grounding wire 66 will be secured to a bare grounding wire within the electrical box or other mounting device in the wall, or to a grounding screw in that box or device. The left-hand edge of the collar 12 of the support 10 will then be pressed against the wall; and fasteners will be passed through the openings 16 and seated in threaded sockets in the electrical box or other mounting device in the wall.

It will be noted that the engagement of the left-hand edge of the collar 12 against the wall eliminates the cost of the traditional metal mounting pan, of the traditional length of metal pipe, and of the fittings therefor. Also, the engagement of the left-hand edge of the collar 12 against the wall eliminates the space occupied by that metal mounting pan, and thereby makes it possible to shorten the conductors 50 and 52 and 66. Also, because the insulated flexible conductors 50 and 52 and the ground wire 66 can assume any random orientation from the opening 36 to the power-supplying conductors in the wall, instead of having to follow the axially-disposed length of metal pipe and then turn at right angles to the axis of that length of pipe to pass to those power-supplying conductors, still further reductions can be made in the lengths of the conductors 52, 54 and 66. Consequently, the present invention not only provides a more compact installation, as by eliminating the bulk of the metal mounting pan, but it reduces the cost of the installation by permitting shorter insulated flexible conductors to be used, by permitting a shorter bare grounding wire to be used, and by eliminating the metal mounting pan and the length of metal pipe and the fittings at the ends thereof. Moreover, the present invention makes certain that the insulating housing 42 will always be in its desired position, by making it impossible for a heavy-handed installer to bend or crush either of the position-defining abutments 28 and 30.

In the support provided by the present invention, the axis of the opening 36 is at a right angle to the plane of the wall-engaging surface 12; and hence that axis will be at a right angle to the wall when the support is mounted on that wall. However, the axis of the screwshell 40 is at a right angle to the axis of the opening 36; and hence the axis of that screwshell is parallel to the plane of the wall-engaging surface 12. All of this means that the axis of any lamp which is held by the screwshell 40 will be parallel to the plane of the wall-engaging surface 12.

Whereas the drawing and accompanying description have shown and described a preferred embodiment of the present invention it should be apparent to those skilled in the art that various changes may be made in the form of the invention without affecting the scope thereof.

What I claim is:

1. A support for an electric lamp which comprises a mounting that has a wall-engaging section and a socket-receiving section and an opening which is between, and which communicates with, said sections, said wall-engaging section having a generally flat wall-engaging surface which is remote from said opening, said wall-engaging section being hollow and having a small cross section adjacent said opening and having a much larger cross section adjacent said wall-engaging surface, said socket-receiving section having a recess that is out of register with, but is close to, said opening, said socket-receiving section also having a plurality of abutments that are out of register with, but that are disposed at opposite sides of and close to, said opening, said mounting being a homogenous molding of polycarbonate and therefore being resistant to flame, heat, cold, water, ice, sunshine and all other natural environmental conditions, a lamp socket which has a plurality of flexible conductors connected thereto and which has a projection that is dimensioned to respond to pressure to enter said recess, said projection having means thereon which permits said projection to enter said recess but thereafter prevents accidental separation of said projection from said recess and thereby prevents accidental separation of said lamp socket from said mounting, said recess and said projection coacting to hold said lamp socket in register with said opening and to force one side of said lamp socket into engagement with said abutments, the force which holds said one side of said lamp socket in engagement with said abutments being large enough to hold said one side of said lamp socket against accidental separation from said abutments but being far too small to bend either of said abutments, said wall-engaging surface being directly engageable with a wall rather than with a metal mounting pan securable to said wall, said flexible conductors passing through said socket-receiving section and said opening and said wall-engaging section to be securable to power-supplying conductors which are largely located within said wall, and said projection and recess and abutments constituting the sole support for said lamp socket to limit the forces which can be developed between said lamp socket and said abutments to values that are far too small to cause bending of said abutments.

2. A support as claimed in claim 1 wherein the cross section of said wall-engaging section increases progressively in size from said opening to said wall-engaging surface so said flexible conductors can assume random orientations between said opening and said wall-engaging surface.

3. A support for an electric lamp which comprises a mounting that has a wall-engaging section and a socket-receiving section and an opening which is between, and which communicates with, said sections, said wall-engaging section having a generally flat wall-engaging surface which is remote from said opening, said wall-engaging section being hollow and having a small cross section adjacent said wall-engaging surface, said socket-receiving section having a recess that is out of register with, but is close to, said opening, said mounting being a homogenous molding of polycarbonate and therefore being resistant to flame, heat, cold, water, ice, sunshine and all other natural environmental conditions, a lamp socket which has a plurality of flexible conductors connected thereto and which has a projection that is dimensioned to respond to pressure to enter said recess, said projection having means thereon which permits said projection to enter said recess but thereafter prevents accidental separation of said projection from said recess and thereby prevents accidental separation of said lamp socket from said mounting, said recess and said projection coacting to hold said lamp socket in register with said opening, said wall-engaging surface being directly engageable with a wall rather than with a metal mounting pan securable to said wall, said flexible conductors passing through said socket-receiving section and said opening and said wall-engaging section to be securable to power-supplying conductors which are largely located within said wall, said opening having an axis that is normal to said wall when said wall-engaging surface is in abutting engagement with said wall, said projection being made of metal and being resilient and being bendable as it is forced to enter said recess, said hollow wall-engaging section enabling said flexible conductors to assume orientations, as they extend from said opening toward said wall, which are displaced from said axis of said opening.

* * * * *